US006250741B1

(12) United States Patent
Wakahara et al.

(10) Patent No.: US 6,250,741 B1
(45) Date of Patent: Jun. 26, 2001

(54) IMAGE FORMING APPARATUS USING GATES AND ELECTRODES FOR SELECTIVELY PASSING TONER

(75) Inventors: Shirou Wakahara, Chiba; Nobuhiko Nakano, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/181,278

(22) Filed: Oct. 28, 1998

(30) Foreign Application Priority Data

Oct. 28, 1997 (JP) ..... 9-295971

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125; 399/271, 290, 292, 294, 295

(56) References Cited

U.S. PATENT DOCUMENTS 5,984,456 * 11/1999 Bern ..... 347/55
6,109,730 * 8/2000 Nilsson et al ..... 347/55

FOREIGN PATENT DOCUMENTS 6-344588 12/1994 (JP) .

* cited by examiner

*Primary Examiner*—John Barlow
*Assistant Examiner*—Raquel Yvette Gordon
(74) *Attorney, Agent, or Firm*—Dike Bronstein Roberts & Cushman IP Group; David G. Conlin; David A. Tucker

(57) ABSTRACT

In an image forming unit having a toner supplying section and a printing section, the toner supported on the toner support is caused to jump through gates so as to pass through the gates and adhere to the paper which is being conveyed from a paper cassette, whereby an image is formed directly on the paper. In this configuration, the jumping of toner from the toner support is controlled based on the application time of the voltage applied to the control electrode, and/or other factors.

8 Claims, 15 Drawing Sheets

Flowchart of the image forming operation

IMAGE FORMING APPARATUS USING GATES AND ELECTRODES FOR SELECTIVELY PASSING TONER

BACKGROUND OF THE INVENTION (1) Field of the Invention

The present invention relates to an image forming apparatus which forms images on a recording medium by causing the developer to jump thereto and in particular relates to an image forming apparatus in which a sufficient amount of toner can be secured for neighboring gates, to thereby prevent degradation of the image.

(2) Description of the Related Art

Conventionally, as a technology to produce a visual image in accordance with an image signal onto a recording medium such as paper and the like, a configuration has been known in which an image is formed directly on the recording medium whilst the passage of charged particles jumping through gates is controlled.

For example, Japanese Patent Application Laid-Open Hei 6 No. 344, 588 discloses an image forming apparatus in which charged particles are placed in an electric field so that they will jump by electric force whilst the potential being applied to the control electrode, having a number of passage holes and located in the jump path, is being varied, to thereby make the charged particles adhere to the recording medium, thus forming a visual image on the recording medium, directly.

In image forming apparatuses of this type, represented by this prior art, either the jumping or non-jumping of toner is selected by controlling the electric field formed between the gates and the toner support, so that the toner is made to reach to the paper surface as a recording medium by a strong electric field generated by the opposing electrode.

However, in a configuration in which the control electrode is spaced about 100 $\mu$m for example, from the toner support, the area on the toner support from which toner has jumped is usually greater than the area of the gate provided on the control electrode. In other words, when the toner is caused to jump through a certain gate, toner jumps toward the gate from an area greater than that of the gate. Therefore, when taking into consideration a plurality of gates neighboring each other, there occur cases in which the area on the toner support opposing each gate may have an insufficiency of toner.

In this way, if a sufficient amount of toner cannot be secured for neighboring gates, dots having a predetermined diameter and a predetermined density cannot be formed, resultantly producing degradation of the image. In particular, when a monochrome solid image in which a certain density of a color is printed uniformly (hereinbelow referred to as 'solid image') needs to be formed, areas with a lower amount of toner will appear as white lines. On the other hand, when a multi-color image is taken into consideration, out of registration occurs so that it is impossible to reproduce the correct original colors.

If this problem is tried to be solved by increasing the amount of toner on the support, or by increasing the conveyed amount or the packing density of toner, it becomes more difficult to form a stable toner layer as the packing density or the conveyed amount is increased more and more because of the fact that the characteristic values of the toner cannot be controlled independently.

On the other hand, even if the voltage to be applied to the gates to cause jumping of the toner is increased or if the pulse width of the voltage to be applied is made greater toward the downstream side, this method is only effective within a markedly limited range of applications and is not practicable to a real situation, because such defects do not always occur at the specified gates.

SUMMARY OF THE INVENTION

It is therefore an object of the present invention to provide an image forming apparatus which, when forming an image on a recording medium by controlling the passage of the charged toner particles jumping through gates, can secure a sufficient amount of toner for neighboring gates, to thereby solve the above problems and prevent degradation of the image.

In order to achieve the above object, the present invention is configured as follows:

In accordance with the first aspect of the invention, an image forming apparatus at least comprises:

- a supplying means having a developer support carrying a developer;
- an opposing electrode disposed facing the developer support;
- a high voltage power source supplying a high voltage to generate a potential difference between the developer support and the opposing electrode;
- a control electrode comprising:
  - an insulative substrate disposed between the developer support and the opposing electrode;
  - a plurality of gates formed in the insulative substrate;
  - one or more electrode groups provided around the plural gates; and
- a control means imparting plural levels of potential states to each electrode group of the control electrode, wherein the control means controls the passage of the developer through gates by applying the designated voltage to the electrode groups so as to form an image on the surface of a recording medium which is being conveyed over the opposing electrode, and is characterized in that, the control means controls the developer supported at the positions corresponding to the gates or in the vicinity thereof on the developer support such that only the developer facing the gates and residing in the topmost layer or in the vicinity thereof jumps through the gates.

In accordance with the second aspect of the invention, the image forming apparatus having the above first feature is characterized in that, when a developer existing at an area of the surface of the developer support is allowed to jump through neighboring plural number (m) of gates provided in the control electrode, the control means controls the jumping of the developer such that the amount of the developer jumping through each of the neighboring gates, qn($1 \leqq n \leqq m$) and the amount of the developer originally existing at the area, Q, satisfy the formula:

$$Q \geqq \sum_{n=1}^{m} qn \tag{1}$$

In accordance with the third aspect of the invention, the image forming apparatus having the above first or second feature is characterized in that the control means controls the application time of the voltage applied to the control electrode so as to apply the voltage to cause the developer supported on the developer support to jump through the plural gates.

In accordance with the fourth aspect of the invention, the image forming apparatus having the above first or second feature is characterized in that the control means controls the potential level of the voltage applied to the control electrode so as to apply the voltage for causing the developer supported on the developer support to jump through the plural gates.

In accordance with the fifth aspect of the invention, the image forming apparatus having the above first or second feature is characterized in that the control means applies the voltage for causing the developer supported on the developer support to jump through the plural gates based on the positional relationship between the developer support and the control electrode.

In accordance with the sixth aspect of the invention, the image forming apparatus having the above first or second feature is characterized in that the control means controls the electric field generated by the control electrode and the opposing electrode to apply the voltage for causing the developer supported on the developer support to jump through the plural gates.

In accordance with the seventh aspect of the invention, the image forming apparatus having the above first or second feature is characterized in that the control means, based on the shapes or sizes of the electrodes provided for the control electrode, applies the voltage for causing the developer supported on the developer support to jump through the plural gates.

In accordance with the eighth aspect of the invention, the image forming apparatus having the above first or second feature is characterized in that the control means comprises using at least one electrode capable of revealing a shielding characteristic and capable of being imparted a potential for controlling jumping or non-jumping of the developer through the plural gates and imparting a potential to the developer supported on the developer support for jumping through the plural gates.

In accordance with the ninth aspect of the invention, the image forming apparatus having the above first or second feature is characterized in that the control means determines the control conditions based on the characteristics of the developer supplied from the supplying means.

DESCRIPTION OF THE PREFERRED EMBODIMENTS

The embodiment of the invention will hereinafter be de scribed with reference to the accompanying drawings.

Figure 1:
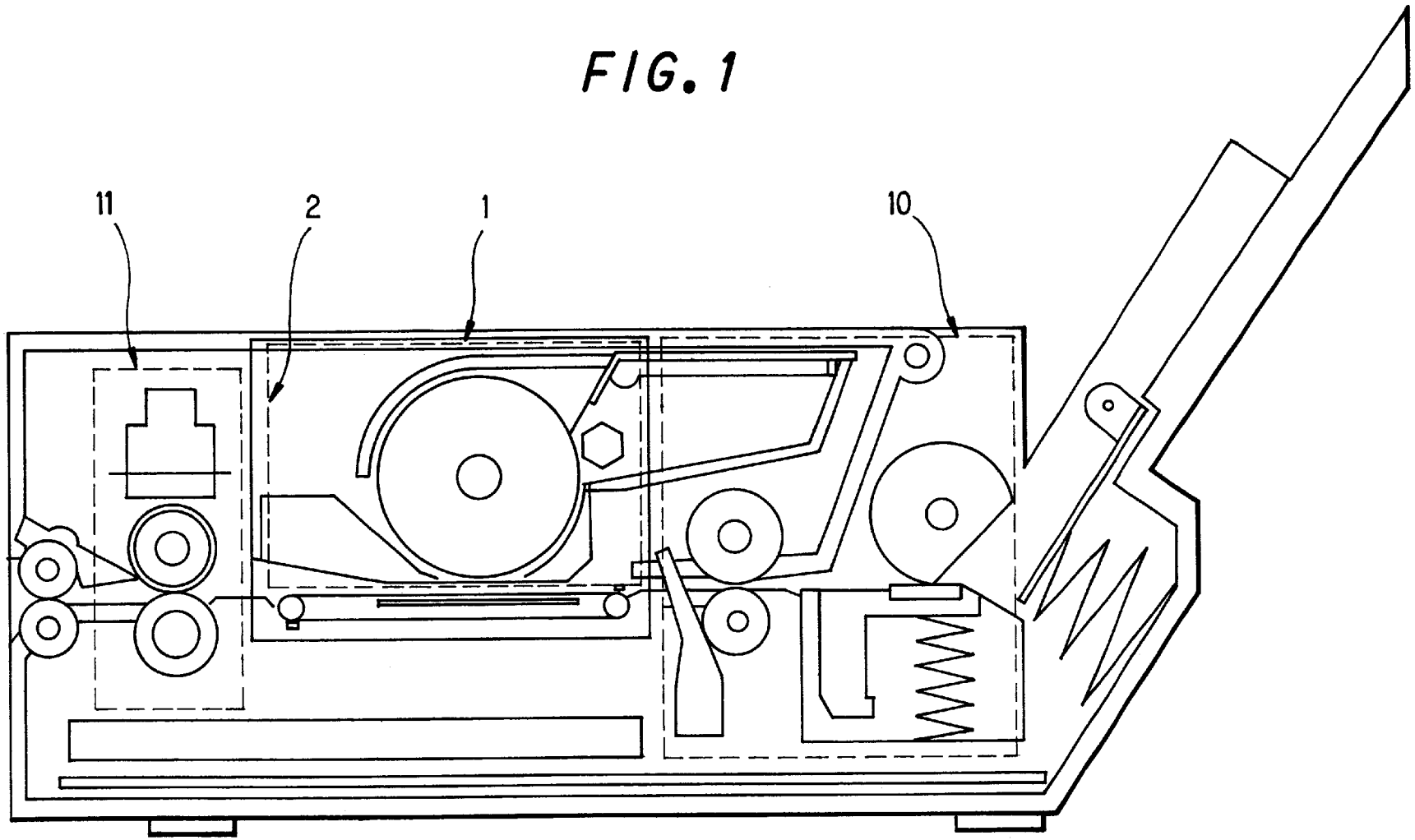
FIG. 1 is a view showing a specific configuration of a printer in accordance with the present embodiment.

FIG. 1 is a sectional view showing a printer in which an image forming apparatus in accordance with the embodiment is mounted. As seen in this figure, this printer comprises: an image forming unit 1 having a toner supplying section 2; a paper feeder 10 for supplying sheets of paper to image forming unit 1; and a fixing unit 11 for fixing the toner image which has been formed on the paper by image forming unit 1.

Focusing on this image forming unit 1, the configuration of the components of the printer will hereinbelow be described.

Figure 2:
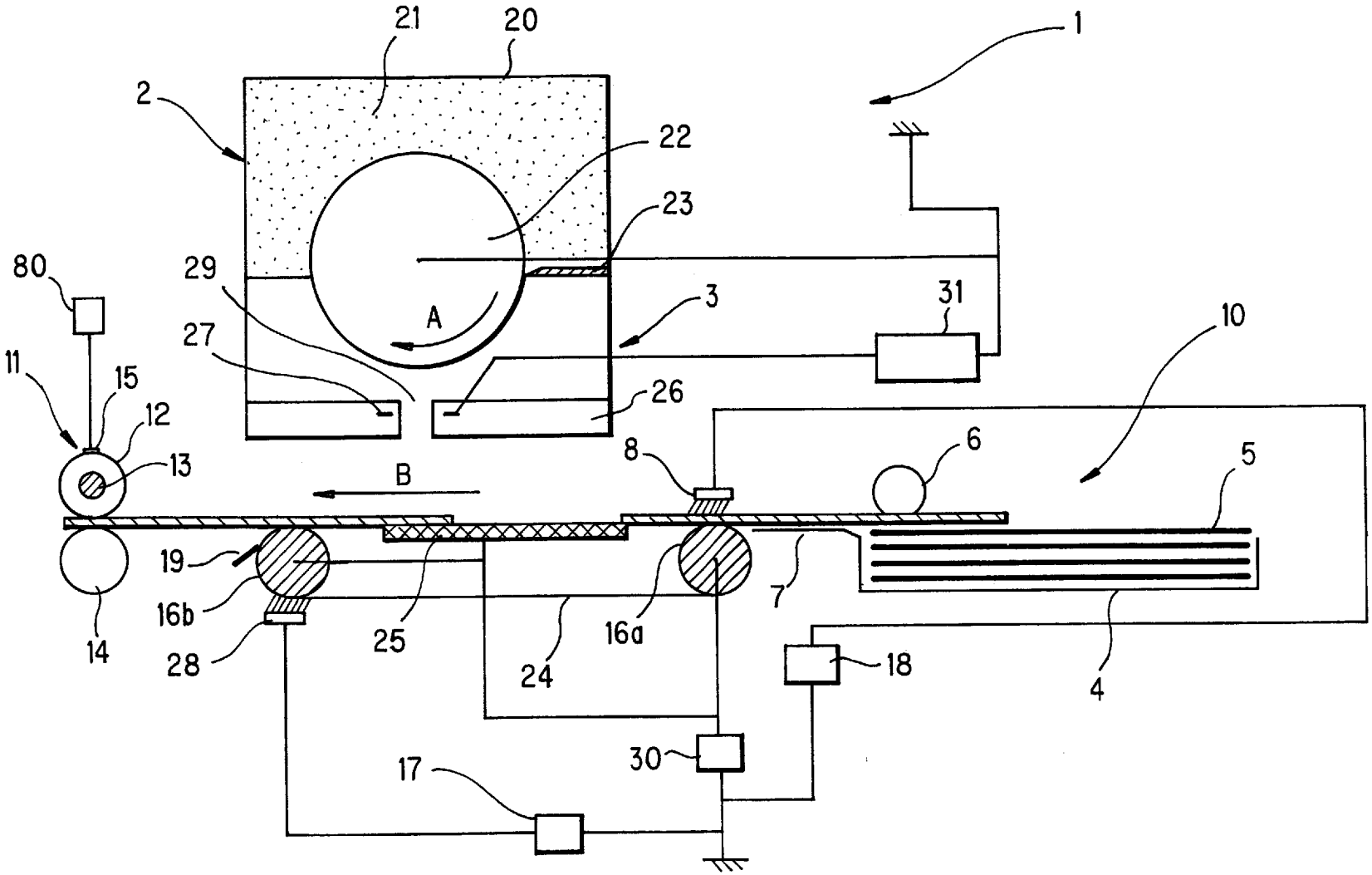
FIG. 2 is a sectional view showing a printer in accordance with the present embodiment.

FIG. 2 is a block diagram showing an illustrative configuration of the components of the printer shown in FIG. 1. In the following description, a configuration for negatively charged toner will be described, but the polarity of voltages to be applied may be appropriately set if positive charged toner is used.

Image forming unit 1 shown in this figure creates a visual image in accordance with an image signal, onto a sheet of paper as recording medium with toner as the developer. More specifically, in this image forming unit, the toner is made to jump and adhere onto the paper whilst the jumping of the toner is controlled based on the image forming signal so as to directly create an image on the paper.

Here, a paper feeder 10 is provided on the input side of image forming unit 1. Paper feeder 10 is composed of a paper cassette 4 for storing paper 5 as recording medium, a pickup roller 6 for delivering paper 5 from paper cassette 4, and a paper guide 7 for guiding fed paper 5. Paper feeder 10 further has an unillustrated detecting sensor for detecting the feed of paper 5. Pickup roller 6 is rotationally driven by an unillustrated driving means.

Provided on the output side of image forming unit 1 is a fixing unit 11 for heating and pressing the toner image which was formed on paper 5 at the image forming unit 1, to fix it onto paper 5. Fixing unit 11 is composed of a heat roller 12, a heater 13, a pressing roller 14, a temperature sensor 15, a temperature controller circuit 80 and an unillustrated paper discharge sensor.

Heat roller 12 is made up of, for example, an aluminum pipe of 2 mm thick. Heater 13 is a halogen lamp which is incorporated in heat roller 12. Pressing roller 14 is made of silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts.

Temperature sensor 15 measures the surface temperature of heat roller 12. Temperature controller circuit 80 which is controlled by a main controller, performs the on/off operation of heater 13 and other control based on the measurement of temperature sensor 15, to maintain the surface temperature of heater roller 12 at 150° C. An unillustrated paper discharge sensor is the one which detects the discharge of paper 5. The materials of heat roller 12, heater 13, pressing roller 14, etc., are not specifically limited. The surface temperature of heat roller 12 also is not specifically limited. Further, fixing unit 11 may use a fixing configuration in which paper 5 is heated or pressed to fix the toner image.

Further, although it is not shown in the drawing, the paper output side of fixing unit 11 has a paper discharge roller for discharging paper 5 processed through fixing unit 11 onto a paper output tray and a paper output tray for holding paper 5 thus discharged. Heat roller 12, pressing roller 14 and the paper discharge roller are rotated by an unillustrated driving means.

Next, toner supplying section 2 as a component of image forming unit 1 will be described illustratively.

As shown in FIG. 2, toner supplying section 2 is composed of a toner storage tank 20 for storing toner 21 as the developer, a toner support 22 of a cylindrical sleeve for supporting toner 21 and a doctor blade 23 which is provided inside toner storage tank 20 to electrify toner 21 and regulate the thickness of the toner layer carried on the peripheral surface of toner support 22.

Doctor blade 23 is arranged on the upstream side with respect to the rotational direction of toner support 22, spaced with a distance of about 60 $\mu$m from the peripheral surface of toner support 22. Toner 21 is of a non-magnetic type having a mean particle diameter of 10 $\mu$m, and is electrified with static charge of about −10 $\mu$C/g by doctor blade 23. Here, the distance between doctor blade 23 and toner support 22 is not particularly limited. Also the mean particle size, the amount of static charge, etc., of toner 21 are not particularly limited.

Toner support 22 is grounded and rotationally driven by an unillustrated driving means so that the surface thereof travels at, for example, 80 mm/sec in the direction indicated by arrow A in the figure. Rotating speed of toner support 22 is not particularly limited, and toner support 22 can be configured so as to support toner 21 by magnetic force, electric force or combination of both.

Next, a specific description will be made of printing section 3 as a component of image forming unit 1.

Printing section 3 includes: an opposing electrode 25 which is made up of an aluminum sheet of 1 mm thick and faces the peripheral surface of toner support 22; a high-voltage power source 30 for supplying a high voltage to opposing electrode 25; a control electrode 26 provided between opposing electrode 25 and toner support 22; a charge erasing brush 28; a charge erasing power source 17 for applying a charge erasing voltage to charge erasing brush 28; a charging brush 8 for charging sheet 5; a charger power source 18 for supplying a charger voltage to charging brush 8; a dielectric belt 24; support rollers 16*a* and 16*b* for supporting dielectric belt 24; and a cleaner blade 19.

Opposing electrode 25 is arranged 1.1 mm apart from the peripheral surface of toner support 22. Dielectric belt 24 is made of PVDF as a base material, and is 75 $\mu$m thick with a volume resistivity of $10^{10}$ Ω·cm. Dielectric belt 24 is rotated by an unillustrated driving means in the direction of the arrow B in the drawing, at a surface speed of 30 mm/sec.

Applied to opposing electrode 25 is a high voltage of 2.3 kV from high voltage power source 30 so that this generates an electric field between opposing electrode 25 and toner support 22, required for causing toner 21 being supported on toner support 22 to lump toward opposing electrode 25.

Charge erasing brush 28 is pressed against dielectric belt 24 at a position downstream, relative to the rotational direction of dielectric belt 24, and of control electrode 26, and has an erasing potential of 2.5 kV applied from charge erasing power source 17 so as to eliminate unnecessary charges remaining on the surface of dielectric belt 24.

Cleaning blade 19 functions as follows: if some toner 21 adhered to the surface of dielectric belt 24 due to a contingency such as paper jam and the like, cleaning blade 19 removes this toner 21 to prevent staining by toner 21 on the paper underside.

The distance between opposing electrode 25 and toner support 22 is not particularly limited. Further, the rotational speed of opposing electrode 25 or the voltage to be applied thereto is not particularly limited either. Although not illustrated for convenience sake of the description, this image forming unit 1 includes: a main controller for controlling the whole image forming apparatus; an image processor for converting the image data into a predetermined format to be printed; an image memory for storage of the image data; and an image forming control unit for converting the image data obtained from the image processor into the image data to be given to control electrode 26.

Control electrode 26 is disposed in parallel to opposing electrode 25 and spreads two-dimensionally facing opposing electrode 25, and it has a structure to permit the toner to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled.

Control electrode 26 is arranged so that its distance from the peripheral surface of toner support 22 is set at 100 $\mu$m, for example, and is secured by means of an unillustrated supporter member. The reference numerals 27, 29 and 31 designate annular electrodes, gates and a control power source, respectively.

Next, a specific configuration of this control electrode 26 will be described.

Figure 3:
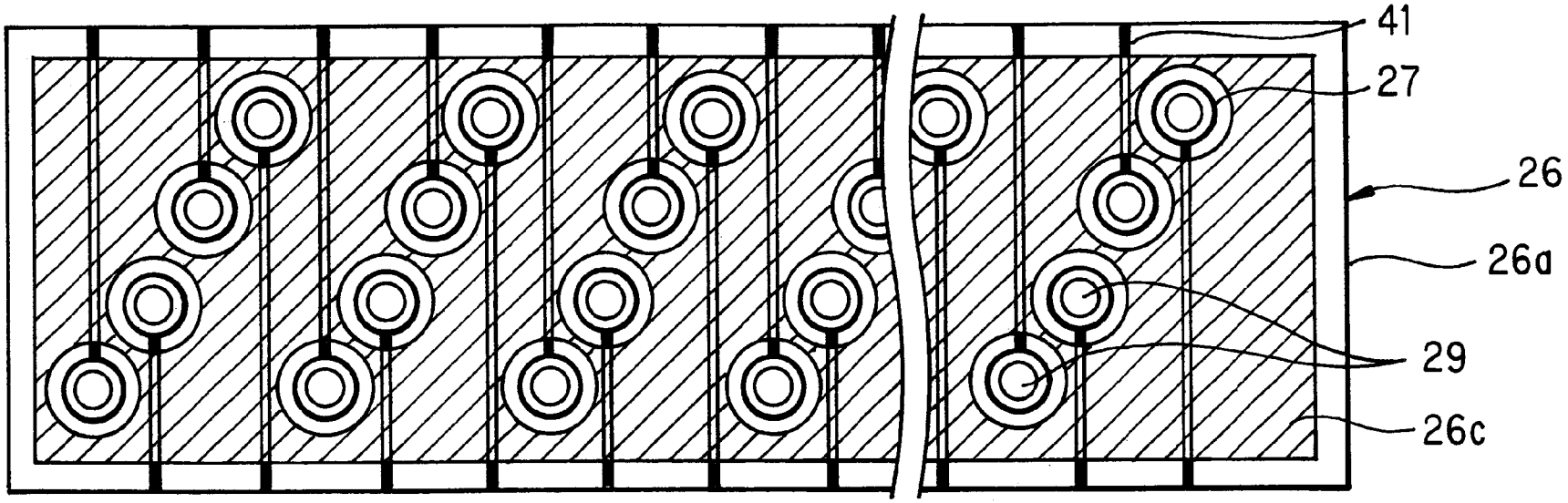
FIG. 3 is a view showing a specific configuration of the control electrode shown in FIG. 2.

FIG. 3 is a diagram showing a specific configuration of control electrode 26 shown in FIG. 2. As shown in this figure, control electrode 26 is composed of an insulative board 26*a*, a high voltage driver (not shown), annular conductors independent of one another, i.e., annular electrodes 27.

Board 26*a* is made from a polyimide resin with a thickness of 25 $\mu$m. The board further has holes forming gates 29, to be mentioned later, formed therein. Annular electrodes 27 are formed of copper foil of 18 $\mu$m thick and are arranged around the holes, in a predetermined layout. Each opening of the hole is formed with a diameter of 160 $\mu$m, forming a passage for toner 21 to jump from toner support 22 to opposing electrode 25. This passage will be termed "gate" hereinbelow. Further, each annular electrode 27 is provided with an opening of 200 $\mu$m in diameter.

Here, the distance between control electrode 26 and toner support 22 is not particularly limited. The size of gates 29 and the materials and thickness of insulative board 26*a* and annular electrodes 27 are not particularly limited either. The holes of annular electrodes 27, i.e., gates 29 are formed at 2,560 sites. Each annular electrode 27 is electrically connected to a control power source 31 via feeder line 41 and an unillustrated high voltage driver. The number of annular electrodes 27 is not particular limited. The surface of annular electrodes 27 and the surface of feeder lines 41 are covered with an insulative layer 26*c* of 30 μm thick, which ensures insulation between annular electrodes 27, insulation between feeder lines 41, insulation between annular electrodes 27 and feeder lines 41 which are not connected with each other, insulation from toner support 22 and insulation from opposing electrode 25.

Supplied to annular electrodes 27 of control electrode 26 are voltages or pulses in accordance with the image signal from control power source 31. Specifically, when toner 21 carried on toner support 22 is made to pass toward opposing electrode 25, control power source 31 applies a voltage of 150 V (hereinbelow referred to as "ON potential") to annular electrodes 27. When the toner is blocked from passing, a voltage of −200 V (hereinbelow referred to as "OFF potential") is applied thereto.

In this way, whilst the potential to be imparted to control electrode 26 is controlled in accordance with the image signal, a sheet of paper 5 is fed over opposing electrode 25 facing toner support 22. Then, a toner image is formed on the surface of paper 5 in accordance with the image signal. Here, control power source 31 is controlled by a control electrode controlling signal transmitted from an unillustrated image forming control unit.

Here, the above image forming unit 1 in accordance with this embodiment can be applied to an output printer for computers, word processors as well as the printing portion of digital copiers. Accordingly, next, description will be made of the case where the image forming unit of this embodiment is used as the printing portion of a digital copier.

Figure 4:
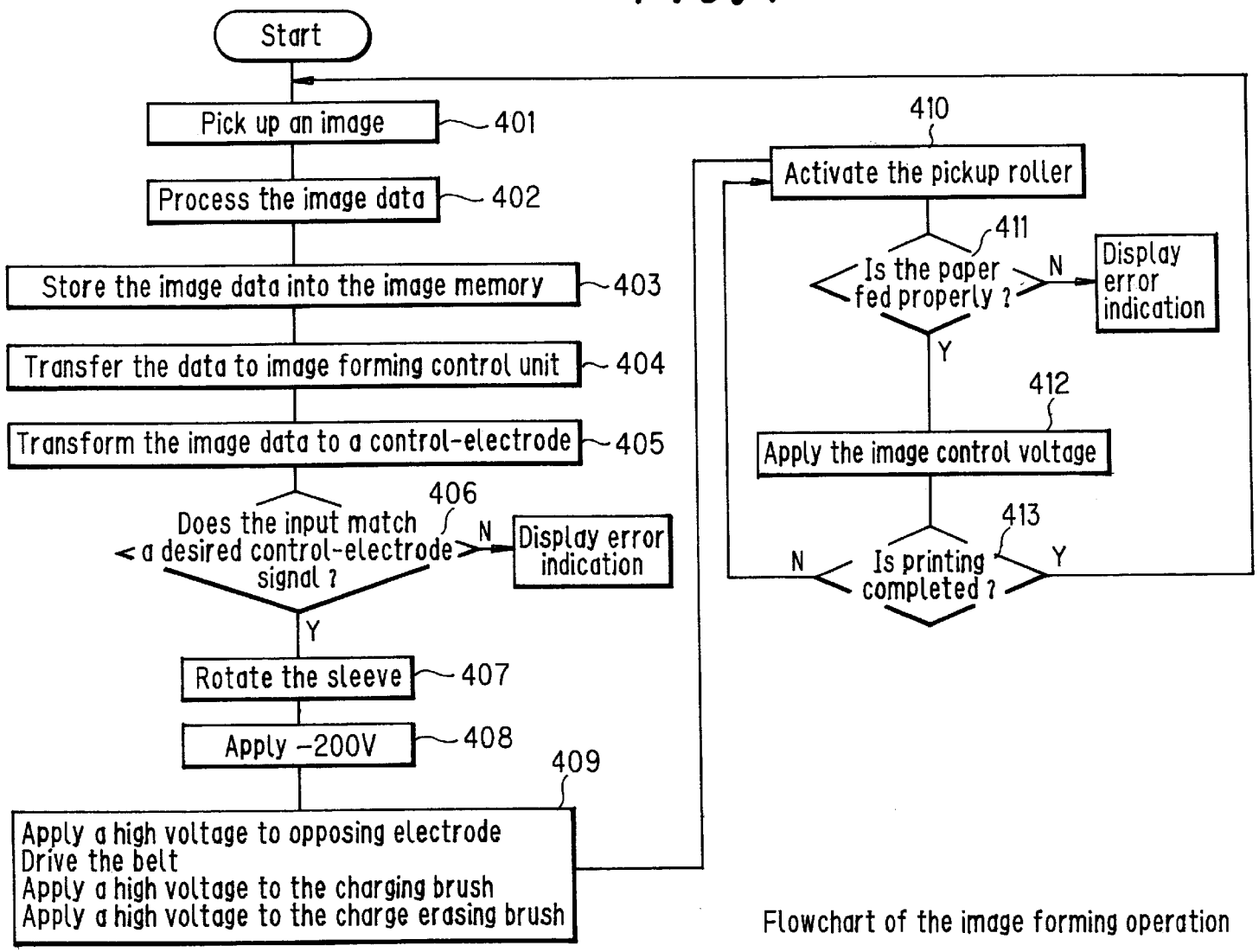
FIG. 4 is a flowchart showing the procedural steps of forming an image when the image forming apparatus shown in FIG. 1 is used as the printing portion of a digital copier.

FIG. 4 is a flowchart showing procedural steps of the image forming process when the image forming unit of this embodiment is used as the printing portion of a digital copier. As shown in this figure, first, when the copy start key is operated with an original to be copied set on the image pickup section, the main controller, in response to this input, starts the image forming operation.

Specifically, the image pickup section starts to read the image from the original (Step 401). The image data thus read is image processed in the image processing section (Step 402) to be stored into the image memory (Step 403). This image data thus stored in the image memory is then transferred to the image forming control unit (Step 404). This image forming control unit converts the input image data into a control electrode controlling signal to be given to control electrode 26 (Step 405).

When the image forming control unit acquires a predetermined amount of the control signal (Step 406), the sleeve starts to rotate (Step 407) and a voltage of −200 V is applied (Step 408). Then high volt age is applied to the opposing electrode, the belt is driven and high voltages are applied to the charging brush and the charge erasing brush (Step 409). Thereafter, an unillustrated driver is activated to rotate pickup roller 6 shown in FIG. 2, which delivers a sheet of paper 5 out from paper cassette 4 toward image forming unit 1 (Step 410). At that moment, at Step 411, it is judged whether the paper is fed normally or not. Paper 5 delivered out by pickup roller 6 is conveyed between charging brush 8 and support roller 16*a*. A voltage capable of giving the same potential as opposing electrode 25 is applied to support member 16*a* from high voltage power source 30 while a charging potential of 1.2 kV is applied to charging brush 8 from charger power source 18 (Step 412).

As a result, paper 5 is supplied with charges due to the potential difference between charging brush 8 and support member 16*a*, so that paper 5, whilst it is electrostatically attracted to dielectric belt 24, is conveyed to a position in printing section 3 of image forming unit 1, where dielectric belt 24 faces control electrode 26. The aforementioned predetermined amount of the control electrode controlling signal may be different depending on the configuration etc. of the image forming apparatus. Thereafter, the image forming control unit supplies the control electrode controlling signal to control power source 31. This control electrode controlling signal is supplied at a time synchronized with the supply of paper 5 from charging brush 8 to printing section 3.

Control power source 31 controls the voltages to be applied to annular electrodes 27 of control electrode 26 based on this control electrode controlling signal. Illustratively, the voltage, 150 V or −200 V is appropriately applied to predetermined annular electrodes 27 from control power source 31 so as to control the electric field around control electrode 26. Accordingly, at each gate 29 of control electrode 26, the jumping of toner 21 from toner support 22 toward opposing electrode 25 is prevented or permitted appropriately in accordance with the image data. Thus, a toner image in conformity with the image signal is formed on paper 5 which is moving at the rate of 30 mm/sec toward the paper output side by the advance of dielectric belt 24 on the surface of opposing electrode 25.

Paper 5 with the toner image formed thereon is separated from dielectric belt 24 by the curvature of support member 16*b* and is conveyed to fixing unit 11, where the toner image is fixed to paper 5. Paper 5 with the toner image fixed thereon is discharged by the discharge roller onto paper output tray. At the same time, the fact that the paper is normally discharged is detected by the paper discharge sensor. Then, the main controller judges the printing operation to be normally completed, from the above detection. By the series of image forming steps described above, a good image is created on paper 5. Since this image forming apparatus directly forms the image on paper 5, it is no longer necessary to use a developer medium such as photosensitive member, dielectric drum, and the like, which were used in conventional image forming apparatuses.

In this way, in accordance with this image forming process, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus in size and cost. The image forming apparatus of the above embodiment may be used as the printing portion of an output terminal for a computer or may be used as the printing portion of a digital copier. In either case, the method of the image forming operation itself is not different though the image signal to be processed and the way of signal exchange are different from each other.

Since toner support 22 is grounded while opposing electrode 25 and support member 16*a* have a high voltage of 2.3 kV applied and charging brush 8 has a high voltage of 1.2 kV applied, negative charge is supplied to the surface of paper 5 fed between charging brush 8 and dielectric belt 24, by the potential difference between charging brush 8 and support member 16*a*. As supplied with negative charge, paper 5 is attracted to dielectric belt 24 by the static electric force of the charge and is conveyed to directly below gates 29 as dielectric belt 24 moves. The charge on dielectric belt 24 attenuates with time, hence, when it reaches directly below gates 29 it will have a surface potential of 2 kV due to the equilibrium with the potential of opposing electrode 25.

In this condition, in order for toner 21 carried on toner support 22 to pass toward opposing electrode 25, control power source 31 is caused to apply a voltage of 150 V to annular electrodes 27 of control electrode 26. When toner 21 needs to be stopped passing through gates 29, a voltage of −200 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired. Further, the voltage to be imparted to annular electrodes 27 of control electrode 26 to prevent passage of toner 21 should not be particularly limited.

Up to now, the configuration and procedural steps of the image forming apparatus in accordance with this embodiment are discussed.

Next, the jumping control of toner 21 effected in the image forming apparatus of this embodiment will be described. Before the description of specific control of jumping, problems relating to the jumping of toner will be discussed illustratively with reference to FIGS. 5 to 7.

Figure 5:
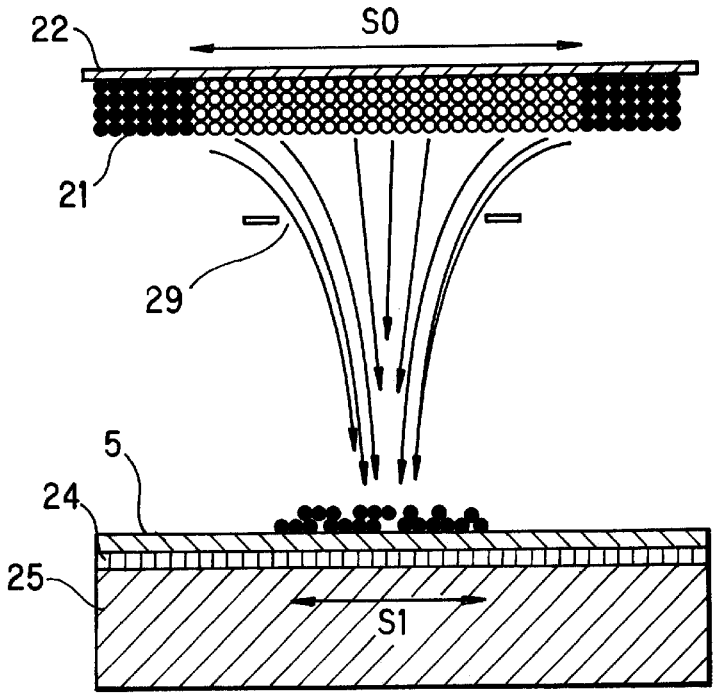
FIG. 5 PRIOR ART
FIG. 5 is an illustrative view for explaining the problem relating to the jumping of toner.
Figure 6:
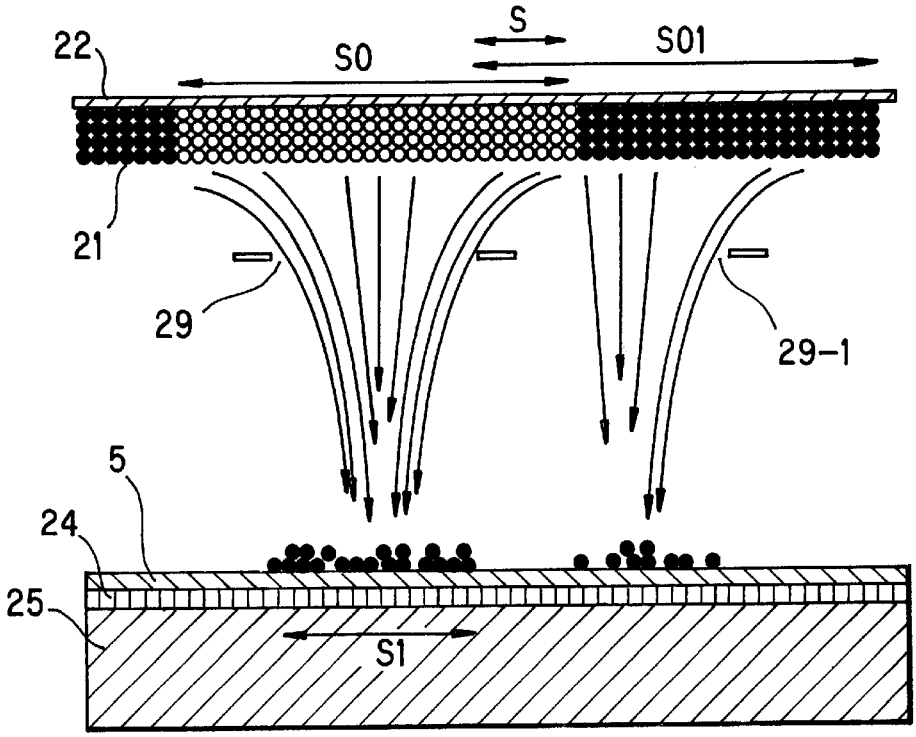
FIG. 6 PRIOR ART
FIG. 6 is an illustrative view for explaining the problem relating to the jumping of toner.

FIGS. 5 and 6 are schematic views showing the jumping of toner 21. The reference numerals 24 and 25 indicate the parts of the corresponding reference numerals in FIG. 2.

As shown in FIG. 5, when the ON potential is applied to an annular electrode 27 of gate 29 provided on control electrode 26, toner 21 supported on toner support 22 jumps from an effective area S0 and converges during jumping to reach the surface of paper 5, forming a dot on paper 5. When the area of the dot formed on the surface of paper 5 is represented by S1, then S0>S1. This way of the transfer of toner 21 to gate 29 will be called 'first type toner transfer'.

Now consider a case where toner 21 jumps toward a gate 29-1 adjacent to gate 29 through which first type toner transfer has occurred. As shown in FIG. 6, an insufficient amount of toner 21 transfers through gate 29-1. This transfer of toner 21 to gate 29-1 will be called 'second type toner transfer'. Further, in another case where toner 21 jumps toward another gate 29-2 (not shown) next to gate 29-1 through which second type toner transfer has occurred, transfer of an insufficient amount of toner 21 occurs again. This transfer of toner 21 to gate 29-2 will be called 'third type toner transfer'.

To sum up, first type toner transfer is one which affects the size and density of the dot (to be formed by second type toner transfer) for a neighboring gate 29, or one which is not affected at all by previous transfer of toner 21; second type toner transfer is one which is affected as to dot size and density by first type toner transfer; and third type toner transfer is one which is affected as to its dot size and density by second type toner transfer.

Now, a further description in detail in this respect will be made. In FIG. 6, when toner 21 is caused to jump through gate 29-1, toner 21 will be caused to jump from effective area S01 which is equi-sized to effective area S0 for gate 29. However, there is an area S without toner 21 residing in it, within the effective area S01 on toner support 22 for gate 29-1 because toner 21 on this area has already transferred from the previous transfer caused by neighboring gate 29 (from first type toner transfer). As a result, if toner 21 is caused to transfer under such conditions, an insufficient amount of toner 21 will transfer and hence the desired dot size and density cannot be obtained. Similarly, when toner 21 is caused to jump through gate 29-2 which is adjacent to gate 29-1, third type toner transfer occurs which cannot produce a dot having sufficiently large diameter and sufficiently high density.

Figure 7:
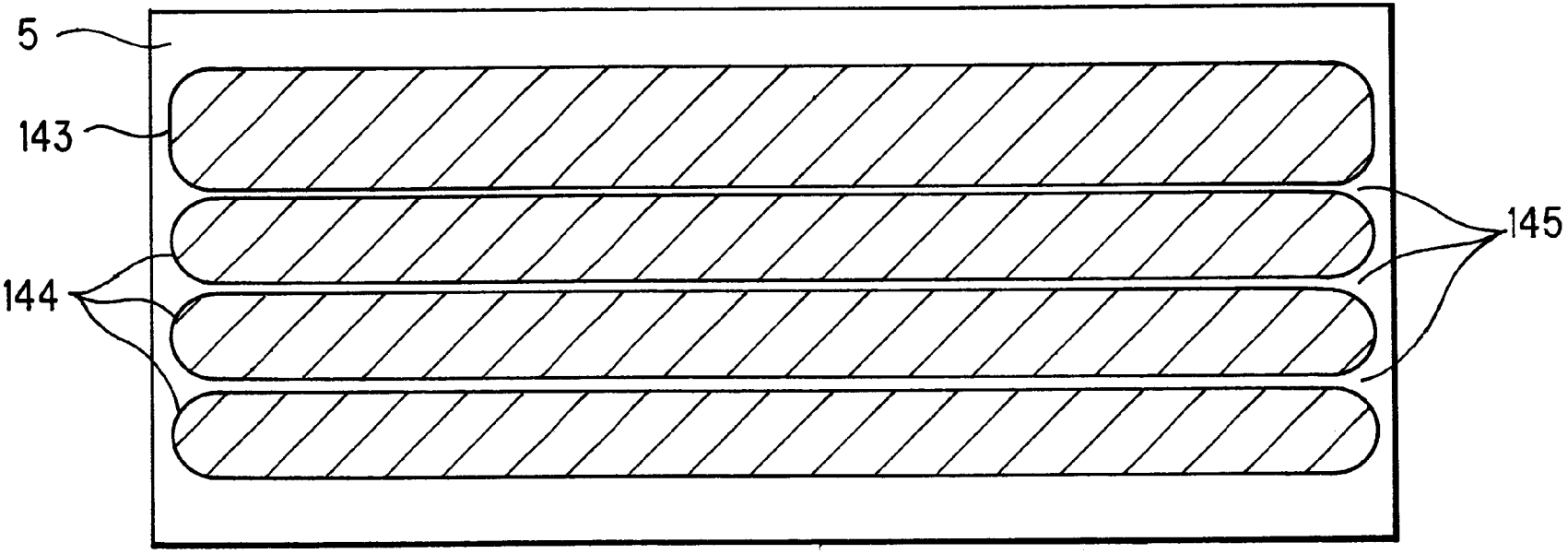
FIG. 7 PRIOR ART
FIG. 7 is an illustration showing an example of white line defects.

Therefore, when a solid image is to be formed under these conditions, the result is only a striped image with white lines therein as shown in FIG. 7 because the dots obtained by the second or third type toner transfer are lacking in dot size and density, causing gaps between the dots.

Illustratively, a line 143 is formed on paper 5 by the dots obtained through first type toner transfer, while lines 144 are formed on the paper by the dots obtained through second and third type toner transfer. The dots obtained through second or third type toner transfer do not have large enough size as stated above, hence line 144 is lacking in line width. Resultantly, gaps 145 (which will be referred to as 'white line defects') occur between lines 144 and/or lines 143 and 144.

Up to now, the problems relating to the jumping of toner 21 have been discussed.

Next, the countermeasures against white line defects by the image forming apparatus of this embodiment will be described.

The jumping of toner 21 shown in FIG. 5 does not occur all at once, immediately after, the application of the ON voltage to control electrode 26, but toner layers of a certain amount peel off progressively so that the transfer of the toner ends after a certain time has elapsed from the application of the ON voltage.

First, this mechanism will be described illustratively with reference to FIGS. 8A to 8D and FIG. 9. The reference numerals 22, 27 and 29 indicate the parts of the corresponding reference numerals in FIG. 2.

Figure 8A:
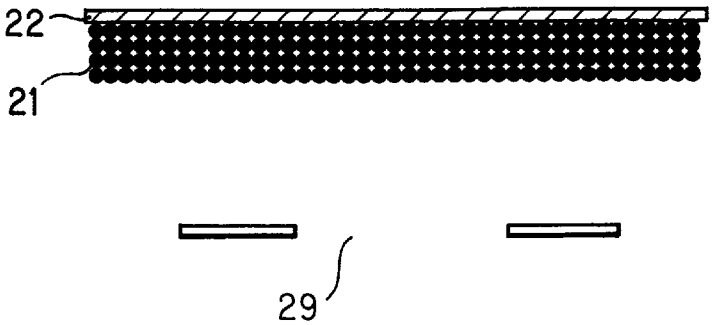
FIGS. 8A to 8D are illustrations explaining the evolution of jumping of the toner.
Figure 8B:
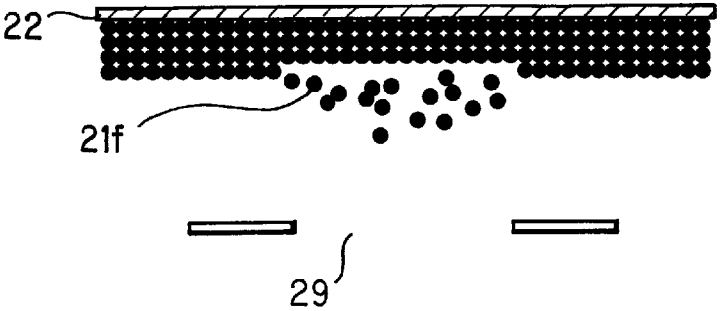
Figure 8C:
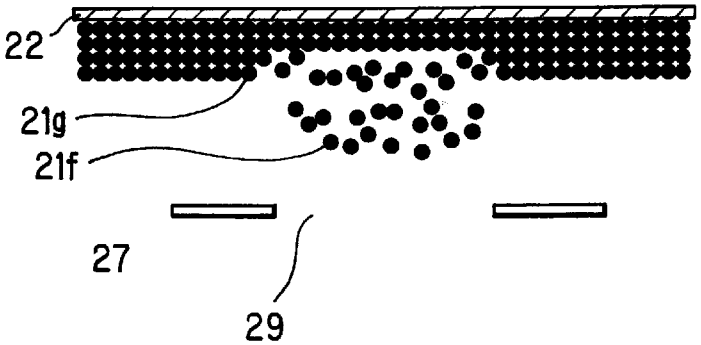

FIG. 8A shows the state before the ON voltage is applied. When the ON voltage is applied, the strong electric field directed toward opposing electrode 25 applies a force on toner 21 so that the topmost layer of toner 21*f* exposed to this strong electric field starts to jump as shown in FIG. 8B. In this case, upon and immediately after the start of toner 21*f* jumping, the second-to-top layer is not exposed to the strong electric field, so that toner 21*g* will not jump. Thereafter, when toner 21*g* becomes exposed to the strong electric field after toner 21*f*, having jumped previously has moved to a certain degree, the second-to-top layer of toner 21*g* starts to jump as shown in FIG. 8C.

Figure 8D:
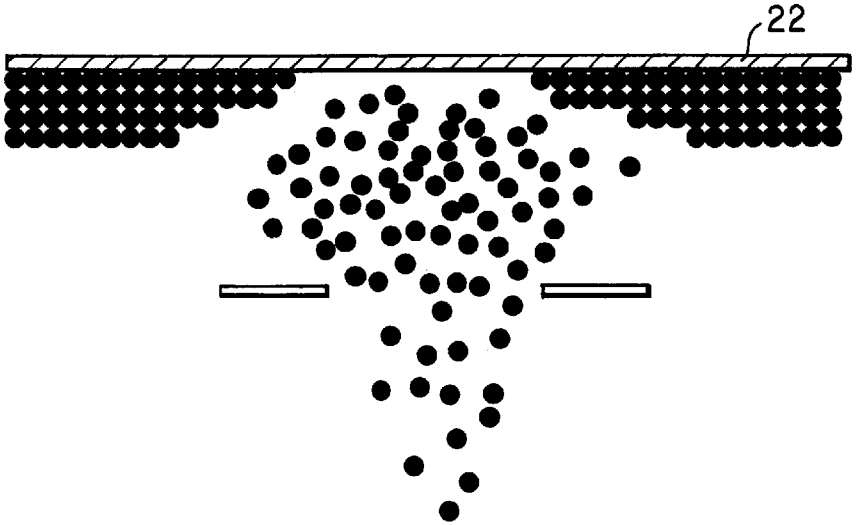
Figure 9:
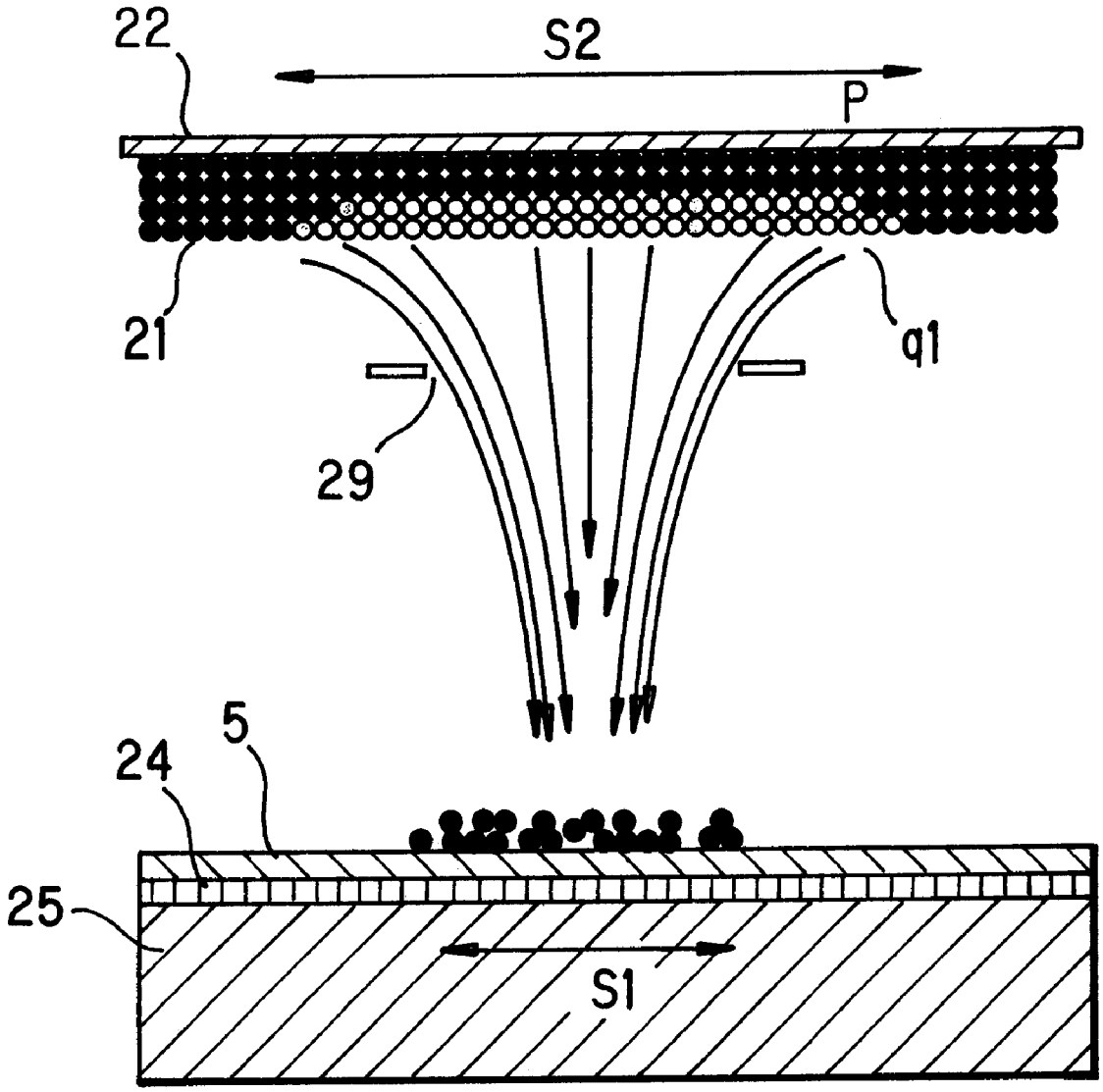
FIG. 9 is a diagram showing a toner jumping state highlighted B the present embodiment.

In this way, in the surface of toner 21, toner 21 successively starts jumping from the topmost layer, and finally produces a jumping state as shown in FIG. 8D. Therefore, by controlling the application time of the ON voltage appropriately, it is possible to retain certain toner layers at effective area S2 without exhausting all toner layers there as shown in FIG. 9. The reference numerals 5, 22, 24, 25, 29 and S1 indicate the parts of the corresponding reference numerals in FIG. 2 and FIG. 5.

Figure 10:
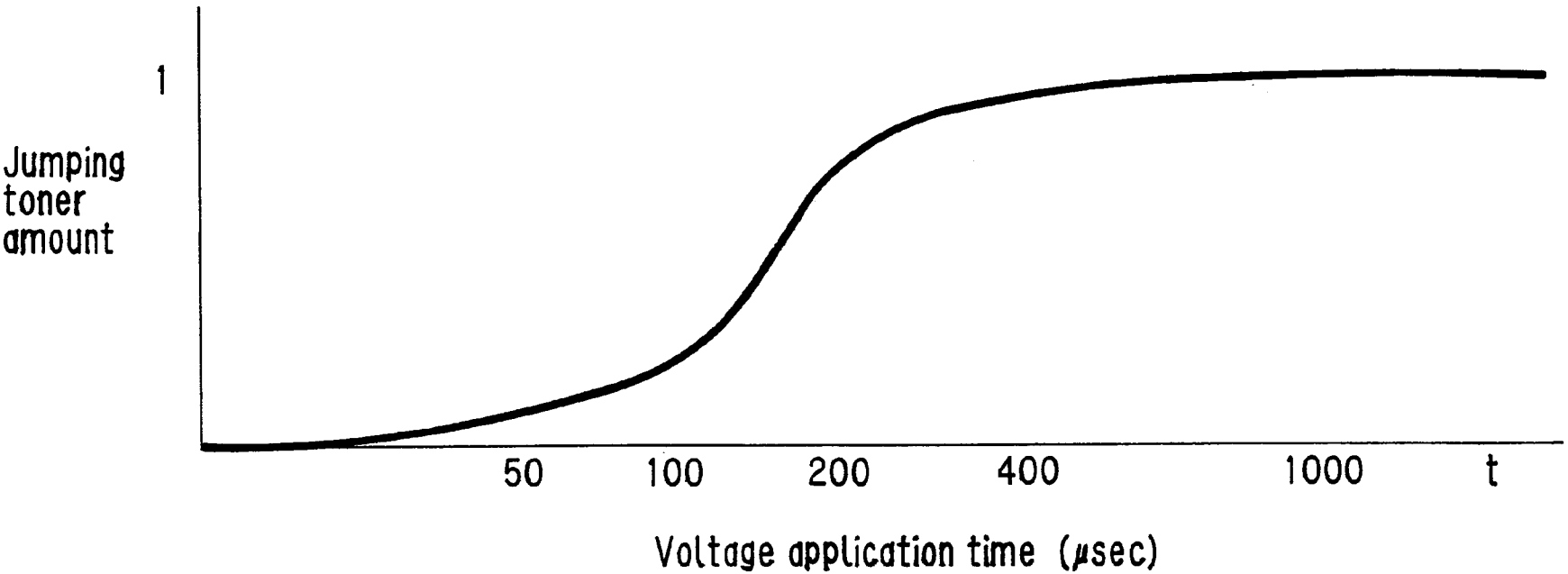
FIG. 10 is a chart showing the relationship between the voltage application time and the amount of the toner jumping.

Next, referring to FIG. 10, the relationship between the application time of the ON voltage and the amount of toner 21 and the control of jumping of toner 21 based on this relationship will be described. Here, the jumping amount of toner 21 at each point of time is normalized based on the jumping amount of toner jumping when the application time of the ON voltage reaches 1000 μsec. As shown in this figure, all the toner 21 in the associated area on toner support 22 has not yet jumped at 200 μsec for example, some toner layers, e.g., layer 21 as shown in FIG. 9 remain on toner support 22 after the jumping of toner 21.

Figure 11:
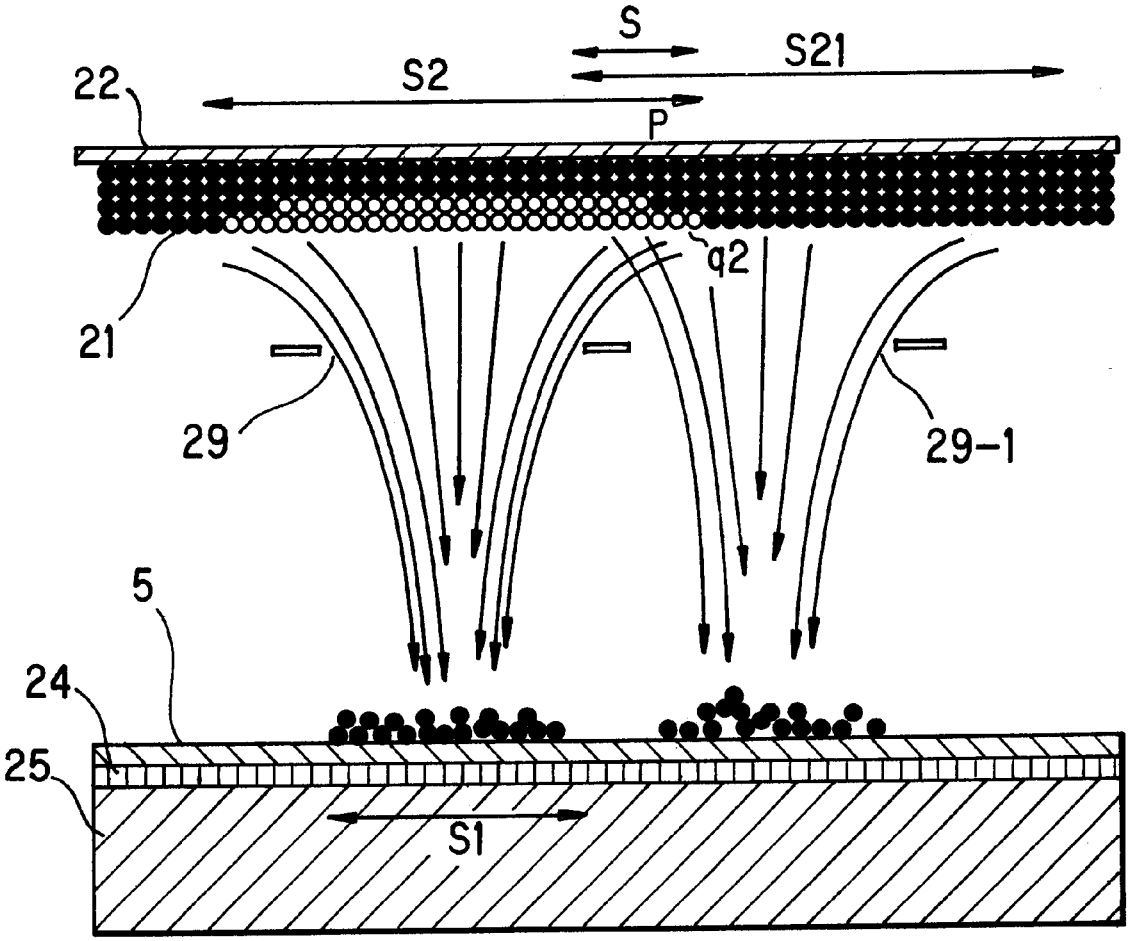
FIG. 11 is a diagram showing a toner jumping state spotlighted in the present embodiment.

In contrast, after 400 μsec has elapsed, almost all the toner in the associated area will jump. Therefore, if printing is performed for two neighboring gates with the application time of the ON voltage set at 200 μm, successful printing can be effected because no toner-free area arises within an effective area S21 corresponding to gate 29-1 as shown in FIG. 11. The reference numerals 5, 24, S and S1 indicate the parts of the corresponding reference numerals in FIG. 2 and FIG. 6.

Control of the voltage application time in the above way is relative stable compared to controlling of the applied voltage, the positional relationship between gate 29 and toner support 22, the characteristics of toner 21 or the characteristics of the toner 21 layer.

FIG. 11 shows the case where the effective areas of two neighboring gates have an overlap. If, for example, the effective area S2 is set very large, three or more effective areas may overlap with one another. In such a case, the transfer conditions of toner 21 may be controlled so that toner 21 can jump to all of the gates 29 opposing these effective areas. For example, a point P in FIGS. 9 and 11 is one which exists in an overlap area between two effective areas from which the toner jumps to two neighboring gates 29 and 29-1. In this case, when Q represents the amount of toner 21 at point P, q represents the amount of toner 21 jumping to gate 29, and q2 represents the amount of toner 21 jumping to gate 29-1, the transfer amounts may and should be controlled so as to satisfy the following relation:

$$Q \geqq q1 + q2$$

When, for example, point P exists in an overlap area of three (or more) effective areas corresponding to gates 29, 29-1 and 29-2, the transfer amounts may be controlled so as to satisfy the following relation:

$$Q \geqq q1 + q2 + q3$$

where q1 and q2 are as defined above and q3 represents the amount of toner 21 jumping to gate 29-2.

Similarly, if point P exists in an overlap area of m effective areas corresponding to gates 29, the transfer amounts may be controlled so as to satisfy the following relation:

$$Q \geqq q1 + q2 + \ldots + qm = \sum_{n=1}^{m} qn \tag{3}$$

where Q is the amount of toner 21 at point P, and qn ($1 \leqq n \leqq m$) are the amounts of the toner jumping to respective gates. Thus it is possible to eliminate the occurrence of a toner-free state at point P with respect to the gates which each have an effective area which contains point P, and hence it is possible to eliminate the problem of white line defect 45.

In this way, while, in the present embodiment, control of toner transfer is performed by adjusting the application time of the ON voltage, it is also possible to control the behavior of toner 21 by adjusting the acceleration of toner 21 with respect to the electric field.

Instead of controlling the application time of the ON voltage, it is also possible to control the level of the ON voltage so as to achieve a similar toner transfer to that shown in FIG. 11. In the case where the application time of the ON voltage is controlled, the control is limited by the clock signal which adjusts the application time of the ON voltage. Further, if the application time is set very short, the distortion of the voltage waveform becomes more than negligible and there occur cases where the prescribed voltage cannot be properly applied. Therefore, in such a case, it is preferred to control the ON voltage itself instead of controlling the application time of the ON voltage.

Depending upon the level of the ON voltage, there occur cases in which FETs used for the switching circuit for switching of the ON voltage may not have a high enough withstanding voltage. In this case, some modifications are needed to the control scheme such as, for example, increasing the level of the voltage to be applied to opposing electrode 25, providing an extra power source to apply a voltage to toner support 22, or the like. However, when such control scheme is used, the power source for supplying the voltage to opposing electrode 25 needs a further higher voltage, and/or a means for supplying the voltage to toner support 22, for example, an extra power source or a voltage boosting or step-down means for changing the voltage from other power sources. Therefore, for example, the size and/or the opening diameter of annular electrode 27 may be adjusted so that a desired electric field is formed around the surface of toner support 22. This method makes it possible to improve the cost performance since there is no increase in cost stemming from the use of the extra power source and from the change into a high voltage configuration.

Figure 12:
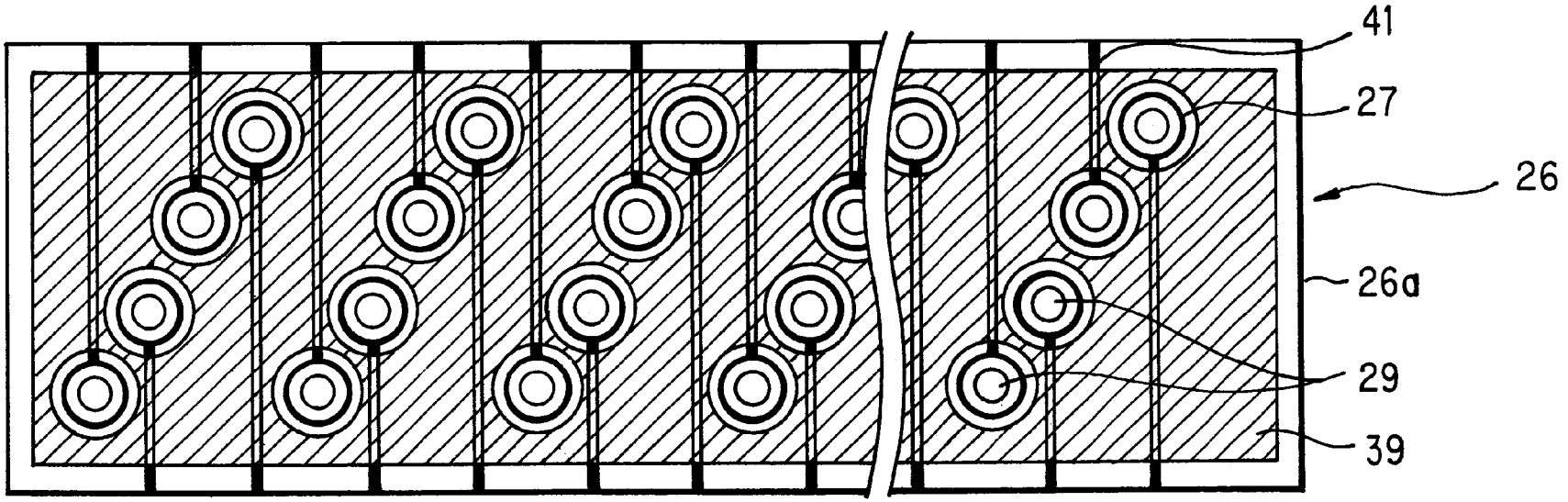
FIG. 12 is a view showing another example of the control electrode shown in FIG. 2.

As to control of the size of the openings, changing the diameter of the openings to less than a certain size will readily induce toner clog in gates 29, therefore this also faces limitations. In such a case, it is also possible to effect the above control based on the positional relationship between control electrode 26 and toner support 22. Further, while the aforementioned control electrode 26 has only annular electrodes 27 provided on insulative board 26*a*, a shield electrode 39, which is formed of a single electrode, may be provided for the control electrode, on its side opposing the toner support 22, as shown in FIG. 12 so that the aforementioned control is applied to this shield electrode 39. The reference numerals 26*a*, 29 and 41 indicate the parts of the corresponding reference numerals in FIG. 3.

Figure 13:
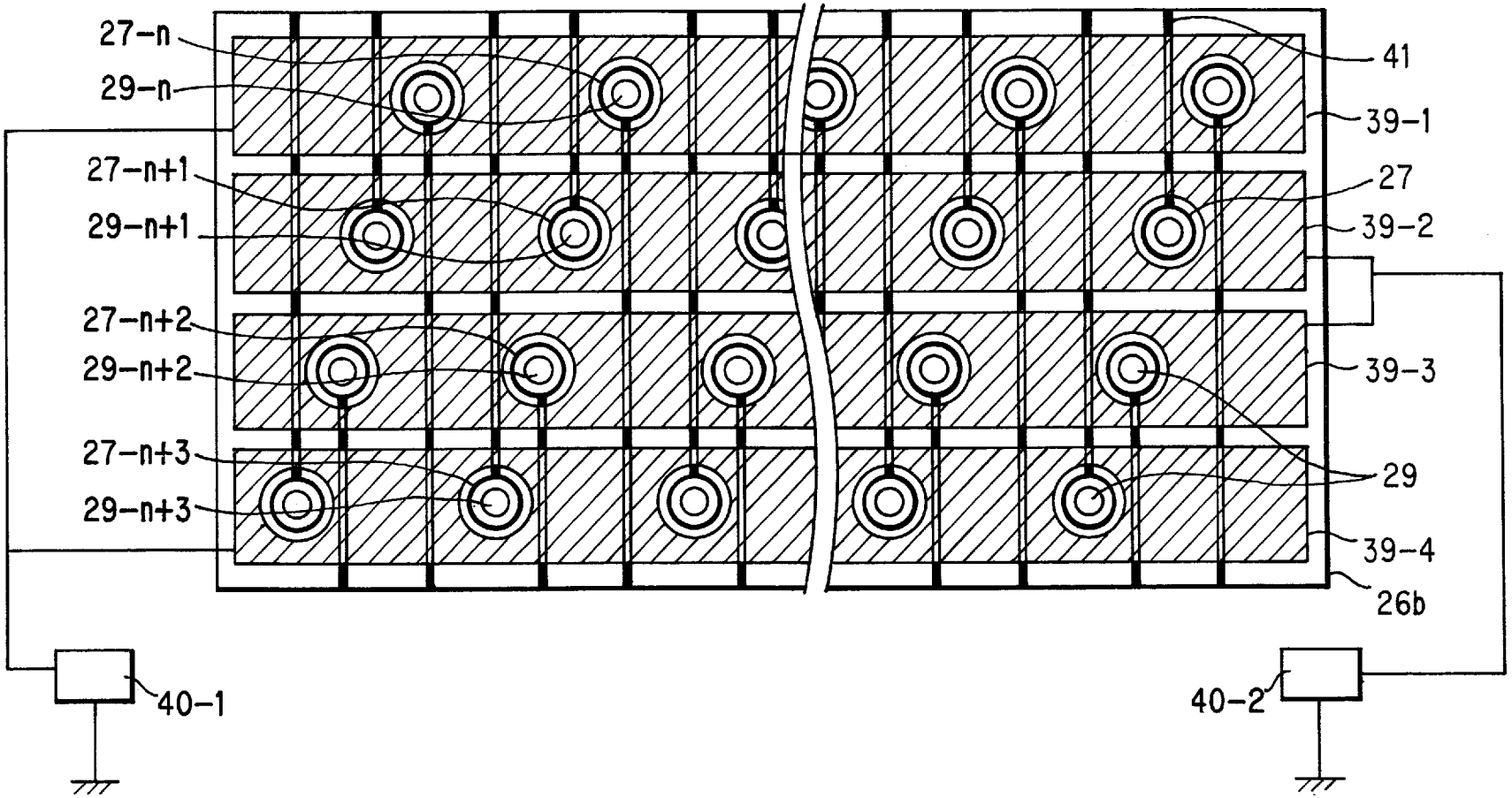
FIG. 13 is a view showing still another example of the control electrode shown in FIG. 2.

It is also preferred to perform the above control of annular electrodes 27, in combination with adjusting the voltage of shield electrode 39 and the diameter of the openings. In this case, the level of the voltage applied to shield electrode 39 can also produce an effect suppressing the voltage applied to annular electrodes 27. Further, while FIG. 12 shows a single shield electrode configuration in which a single sheet of shield electrode 39 is provided, it is also possible to provide sectioned shield electrode elements 39 (39-1, 39-2, 39-3, 39-4) with extra power sources 40-1 and 40-2 as shown in FIG. 13 so that the applied voltage of each shield electrode element 39 may be adjusted individually.

The reference numerals 27-n, 27-n+1, 27-n+2 and 27- n+3 designate annular electrode. The reference numerals 29-n, 29-n+1, 29-n+2 and 29-n+3 designate gate. The reference numerals 27, 29 and 41 indicate the parts of the corresponding reference numerals in FIG. 3.

Figure 14:
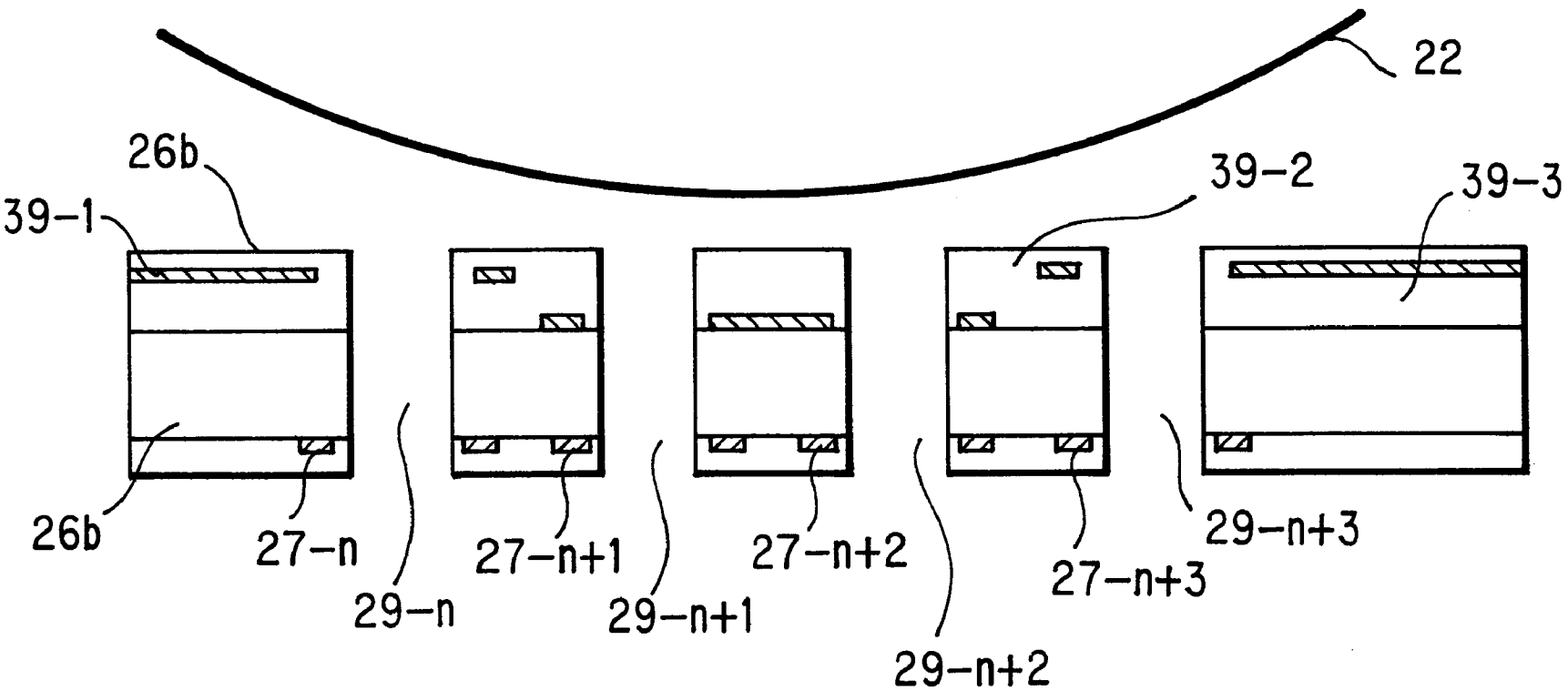
FIG. 14 is a sectional view showing another example of the control electrode shown in FIG. 2.

Further, it is also possible to achieve an effective control by adjusting the geometry of shield electrode elements 39 as shown in FIG. 14. More specifically, when toner support 22 is of a curved surface having a certain curvature, shield electrode elements 39-1 to 39-4 are preferably arranged with respect to the curvature so that the control in accordance with the present embodiment can be performed in a beneficial fashion. The reference numerals 26*b*, 27-n, 27-n+1, 27-n+2, 27-n+3, 29-n, 29 -n+1, 29-n+2 and 29-n+3 indicate the parts of the corresponding reference numerals in FIG. 13.

It is also preferred, as in the configuration shown in FIG. 14, that different voltages are applied to individual shield electrode elements 39. It is also possible to integrate shield electrode elements 39-2 and 39-3 for gates 29-n+1 and 29-n+2 shown in FIG. 13, which have the same distance from toner support 22.

Further, the above control electrode 26 can be applied to various types of image forming apparatuses other than the one described but akin thereto. For example, in the above description of the embodiment, although a single drive control was explained wherein jumping of toner 21 through each gate 29 is controlled by a different electrode, it is also possible to apply the present invention in the same manner to the case where a matrix electrode driven in a matrix drive as shown in FIG. 15 is used.

In this figure, in place of annular electrodes 27, strip-like electrodes 27*a* and 27*b* are arranged with strip-like electrodes 27*b* being provided for control electrode 26 on the side opposing toner support 22 and strip-like electrodes 27*a* on the side facing opposing electrode 25. In this control electrode 26, the number of FETs as the switching means for switching the voltage of individual gates can be markedly reduced. For example, comparing it with the control electrode 26 shown in FIG. 3, the required number of FETs is reduced to about one-fourth. Thus, in view of reducing the number of the needed FETs, the control electrode 26 shown in FIG. 15 is remarkably effective. The reference numerals 26*a* and 29 indicate the parts of the corresponding reference numerals in FIG. 3.

Figure 15:
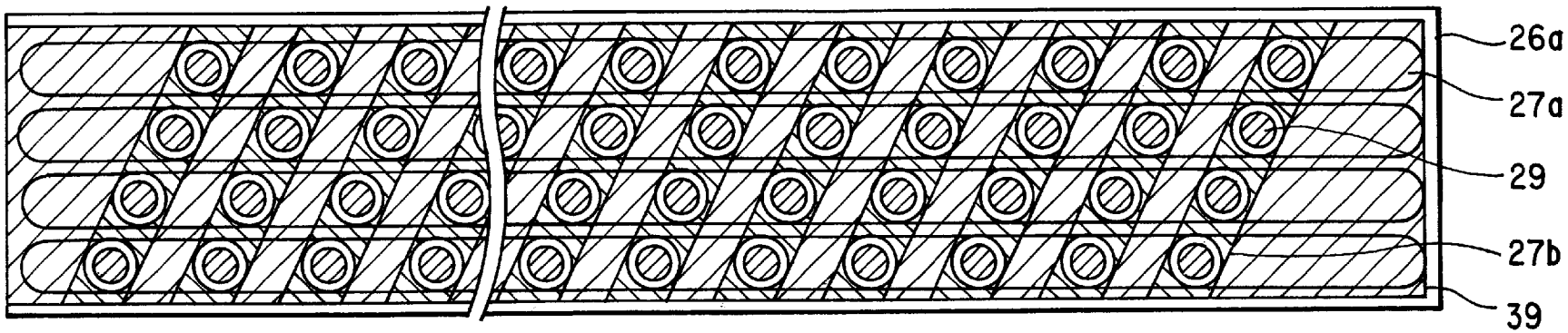
FIG. 15 is a further example of the control electrode shown in FIG. 2.

Although a single sheet of shield electrode 39 is arranged in the configuration of FIG. 15, the present invention should not be limited to this. That is, it is possible to use a configuration in which sectioned shield electrode elements 39 are used as shown in FIG. 14, or a configuration in which no shield electrode 39 is provided. Unlike the above configuration in which a constant voltage is applied continuously to shield electrode 39, it is also possible to switch the potential of shield electrode 39, for example, in time with the application of the voltage to an annular electrode 27 for controlling the jumping of toner 21.

In the present embodiment, either 150 V or −200 V is applied to each annular electrode 27, but this should not limit the present invention. That is, it is possible to apply different voltages to individual annular electrodes 27. For example, different voltages may be applied to different gates 29 such that 150 V is applied to annular electrode 27-n shown in FIG. 14 while 120 V is applied to annular electrode 27-n+1. It is also possible to modify the arrangement and the size of the electrodes and the diameter of the openings in accordance with the distance from toner support 22. Here, specific values of the voltages are determined as appropriate taking into account the specifications and characteristics of an individual apparatus and the characteristics of toner 21 to be used.

Further, if, for example, the level of the ON voltage is adapted to be controlled in parallel with the control of the application time of the ON voltage, it is possible to enlarge the controllable range. As an example, as a resulting of shortening the application time of the ON voltage to a certain degree, the transfer amount of toner 21 may become less, presenting insufficiency in dot size and density. In such a case, the transfer amount of toner 21 can be prevented from lowering by enhancing the level of the ON voltage applied so as to enlarge the effective area.

Described heretofore, were cases where the present invention is applied to a monochrome image forming apparatus. However, the present invention can also be applied to a color image forming apparatus. For example, a color image forming apparatus may be configured by providing a plurality of image forming units 1*a*, 1*b*, 1*c* and 1*d* made up of toner supplying sections 2*a*, 2*b*, 2*c* and 2*d* and printing sections 3*a*, 3*b*, 3*c* and 3*d* wherein toner supplying sections 2*a*, 2*b*, 2*c* and 2*d* are filled with color toners, e.g., yellow, magenta, cyan and black.

Figure 16:
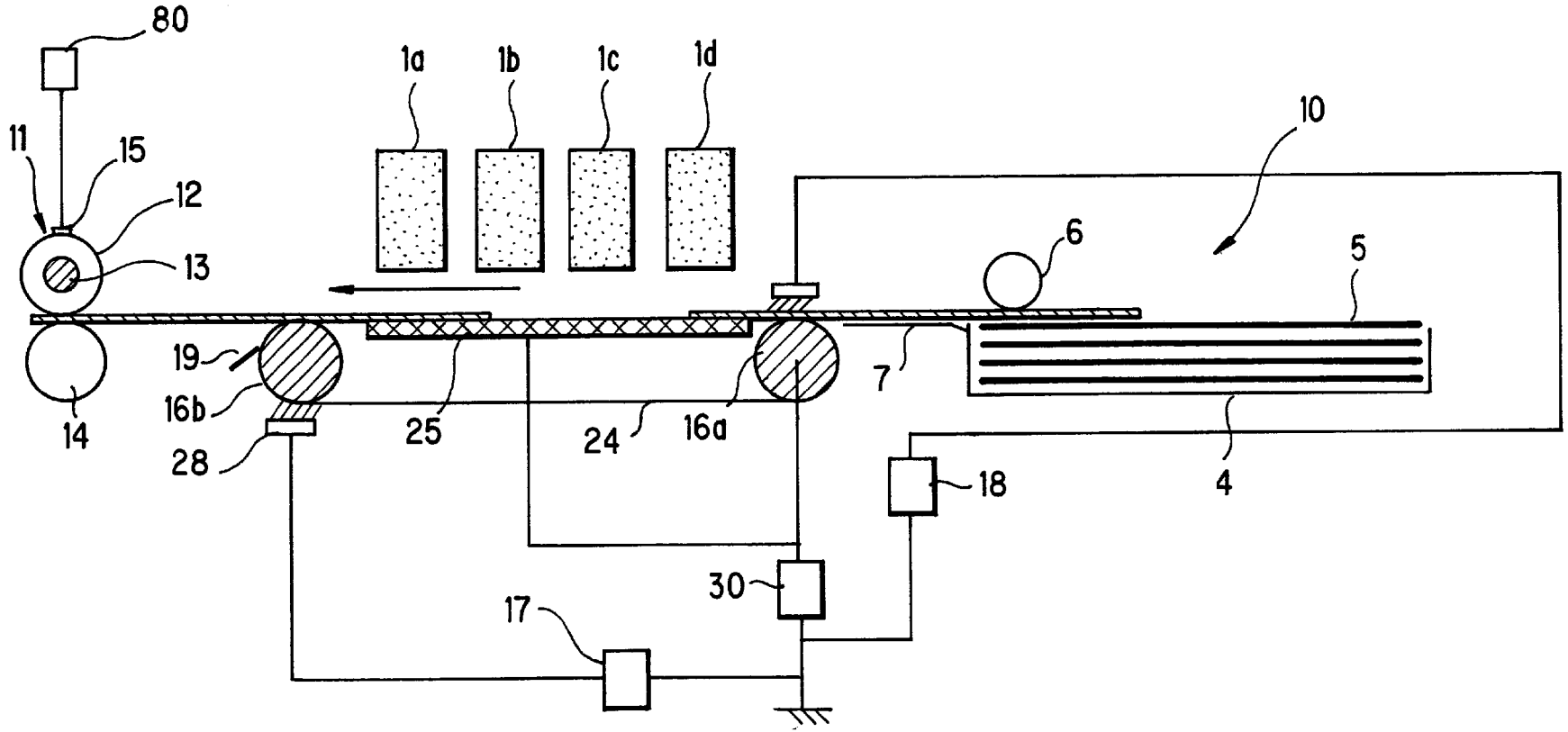
FIG. 16 is a diagram showing a configuration of a color image forming apparatus in accordance with the present embodiment.

FIG. 16 shows an arrangement of image forming units 1*a*, 1*b* 1*c* and 1*d* corresponding to yellow, magenta, cyan and black. Each image forming unit effects image formation in accordance with the image data of the associated color so as to produce a desired color image having a correct reproduction of colors. Further, in the image forming apparatus using multiple toners shown in FIG. 16, each toner 21 can be adapted to have different characteristics so that the toner 21 can be controlled so as to jump in a correct manner by using the image forming unit associated with the toner 21. The reference numerals 4, 5, 6, 7, 10, 11, 12, 13, 14, 15, 16*a*, 16*b*, 17, 18, 19, 24, 25, 30 and 80 indicate the parts of the corresponding reference numerals in FIG. 2.

Here, for the above control, it is not necessary to control the ON voltages of all the image forming units in the same manner. For example, image forming unit 1*a* may be controlled based on the application time of the ON voltage, image forming unit 1*b* may be controlled based on the level of the ON voltage, and image forming unit 1*c* may be controlled based on both the voltage level of toner support 22 and the application time of the ON voltage.

In the description of the embodiments, the example where the toner is used as the developer was explained, but ink etc. can be used as the developer.

The image forming apparatus in accordance with the invention can be preferably applied to the printing unit in digital copiers, facsimile machines as well as to digital printers, plotters, etc.

As has been described in detail, the image forming apparatus in accordance with the first aspect of the invention is configured so that, the control means controls the developer supported at the positions corresponding to the gates or in the vicinity thereof on the developer support such that only the developer facing the gates and residing in the topmost layer or in the vicinity thereof jumps through the gates. Therefore, the effects as follows can be obtained:

1) It is possible to eliminate the problem of insufficiency of the transfer amount of the developer for the neighboring gates.
2) It is possible to inhibit the occurrence of white line defects which would have occurred when neighboring gates are used for printing as in forming a solid image.
3) It is possible to produce desired halftones and correct reproductions of colors.
4) It is possible to produce a good image free from image degradation.

In accordance with the second aspect of the invention, when a developer existing at an area of the surface of the developer support is allowed to jump through neighboring plural number (m) of gates provided in the control electrode, the control means controls the jumping of the developer such that the amount of the developer jumping through each of the neighboring gates, qn($1 \leqq n \leqq m$) and the amount of the developer originally existing at the area, Q, satisfy the formula:

$$Q \geqq \sum_{n=1}^{m} qn \tag{4}$$

Accordingly, it is possible to efficiently eliminate white line defects.

In accordance with the third aspect of the invention, the application time of the voltage applied to the control electrode is controlled so as to apply the voltage to cause the developer supported on the developer support to jump through the plural gates. As a result, the following effects can be obtained.

1) Since the control is based on the application time of the voltage, the control is not likely to be limited by the developer and/or the control electrode, so it is possible to perform the control in a very stable manner.
2) This configuration does not need any extra power source. And increase in cost which would be accompanied by the voltage switching means for controlling the jumping of the developer will not arise.

In accordance with the fourth aspect of the invention, the potential level of the voltage applied to the control electrode is controlled so as to apply the voltage for causing the developer supported on the developer support to jump through the plural gates. As a result, even when the application time of the voltage applied to the control electrode is set very short and hence the distortion of the voltage waveform becomes more than negligible, it is possible to form a good image.

In accordance with the fifth aspect of the invention, the voltage for causing the developer supported on the developer support to jump through the plural gates is applied based on the positional relationship between the developer support and the control electrode. As a result, no distortion occurs in the voltage waveform which would occur if the voltage application time is controlled. Further, there is no increase in the cost which would be needed to provide extra power sources for boosting the applied voltage and FETs as switching means of the voltage.

In accordance with the sixth aspect of the invention, the electric field generated by the control electrode and the opposing electrode is controlled so as to apply the voltage for causing the developer supported on the developer support to jump through the plural gates. As a result, the following effects can be obtained.

1) It is not necessary to increase the voltage to be applied to the control electrode, hence there is no need to use any voltage switching FETs of a high withstanding voltage type.
2) The control electrode is not needed to be put closer than needed with respect to the developer layer, hence it is possible to reduce the risk of the developer coming into contact with and adhering to the control electrode.

In accordance with the seventh aspect of the invention, the voltage for causing the developer supported on the developer support to jump through the plural gates is applied based on the shapes or sizes of the electrodes provided for the control electrode. Therefore, it is possible to suppress the increase in the cost for the power source and for the voltage switching means. Further, it is also possible to eliminate the problems stemming from the positioning of the control electrode close to the developer support.

In accordance with the eighth aspect of the invention, the control means comprises using at least one electrode capable of revealing a shielding characteristic and capable of being imparted a potential for controlling jumping or non-jumping of the developer through the plural gates and imparting a potential to the developer supported on the developer support for jumping through the plural gates. Therefore, the voltage switching means and the arrangement of the control electrode will not be limited anywise.

In accordance with the ninth aspect of the invention, when a plurality of developer supplying units are provided for forming individual colors of an image, the control means determines the control conditions for each developer based on the characteristics of the developer supplied from the supplying means. Accordingly, it is possible to produce a correct image by making full advantage of the characteristics of the developer. In particular, in a color image forming apparatus in which a plurality of developer supplying units are provided for forming individual colors of an image, it is possible to produce a correct color image making use of the characteristics of each developer of a different color to the full extent.

What is claimed is:

1. An image forming apparatus at least comprising:

a developer supply device including a developer support having a surface adapted to carry a layer of a developer material;

an opposing electrode disposed facing at least a portion of the developer support surface;

a high voltage power source supplying a high voltage for creating a potential difference between the developer support and the opposing electrode;

a control electrode comprising:

an insulative substrate disposed between the developer support and the opposing electrode, said insulative substrate defining a plurality of gates extending transversely therethrough; and one or more electrode groups provided around each of the plurality of gates; and control means for applying predetermined voltages to each of the electrodes of the groups thereof so as to create predetermined electrical potential states in each of the gates such that a desired image may be formed on a surface of a recording medium simultaneously conveyed over the opposing electrode by developer material selectively jumping from the developer support surface through predetermined neighboring ones of the plurality of gates, the apparatus being further characterized in that, the control means controls the layer of developer material carried on the surface of the developer support at each position (Q) corresponding to the predetermined neighboring ones of the plurality of sates (m), or in the vicinity thereof, such that only developer material facing the predetermined neighboring ones of the plurality of gates and residing in a topmost part of the layer of the developer material carried by the developer support, or in the vicinity thereof, simultaneously jumps through the plural gates, and when developer material present at a position (Q) on the surface of the developer support is allowed simultaneously to jump through the predetermined neighboring ones of the plurality of gates, the control means controls the jumping of the developer material such that the amount of the developer material jumping through each gate is respectively given by the relation $qn(1 \leqq n \leqq m)$ and the amount of the developer material originally present at each position (Q) satisfies the formula:

$$Q \geq \sum_{N=1}^{m} qn. \quad (1)$$

2. The image forming apparatus according to claim 1, wherein the control means controls the application time of the voltage applied to the control electrode so as to apply the voltage to cause the developer supported on the developer support to jump through the plural gates.

3. The image forming apparatus according to claim 1, wherein the control means controls the potential level of the voltage applied to the control electrode so as to apply the voltage for causing the developer supported on the developer support to jump through the plural gates.

4. The image forming apparatus according to claim 2, wherein the control means applies the voltage for causing the developer supported on the developer support to jump through the plural gates based on the positional relationship between the developer support and the control electrode.

5. The image forming apparatus according to claim 1, wherein the control means controls the electric field generated by the control electrode and the opposing electrode to apply the voltage for causing the developer supported on the developer support to jump through the plural gates.

6. The image forming apparatus according to claim 1, wherein the control means, based on the shapes or sizes of the electrodes provided for the control electrode, applies the voltage for causing the developer supported on the developer support to jump through the plural gates.

7. The image forming apparatus according to claim 1, wherein the control means comprises using at least one electrode capable of revealing a shielding characteristic and capable of being imparted a potential for controlling jumping or non-jumping of the developer through the plural gates and imparting a potential to the developer supported on the developer support for jumping through the plural gates.

8. The image forming apparatus according to claim 1, wherein the control means determines the control conditions based on the characteristics of the developer supplied from the supplying means.

* * * * *

UNITED STATES PATENT AND TRADEMARK OFFICE

CERTIFICATE OF CORRECTION

PATENT NO. : 6,250,741 B1
DATED : June 26, 2001
INVENTOR(S) : Shirou Wakahara, Nobuhiko Nakano It is certified that error appears in the above-identified patent and that said Letters Patent is hereby corrected as shown below:

Column 16,
Line 53, please change "states(m)" to -- gates(m) --;
Lines 54 and 58, please change "the vicinity" to -- a vicinity --;

Column 17,
Line 3, please change "qn." to -- qn --;
Line 3, please change "(1)" to -- (1). --;
Line 17, please change "claim 2" to -- claim 1 --.

Signed and Sealed this

Twenty-sixth Day of February, 2002

*Attest:*

*Attesting Officer*

JAMES E. ROGAN
*Director of the United States Patent and Trademark Office*